US005125762A

United States Patent [19]

Strassil

[11] Patent Number: 5,125,762

[45] Date of Patent: Jun. 30, 1992

[54] SHOCK ENERGY DISSIPATION TRAFFIC DIVIDER BARRIER

[75] Inventor: Carlo Strassil, Rome, Italy

[73] Assignee: C.R.A. Centro Ricerche Applicate S.p.A., Rome, Italy

[21] Appl. No.: 648,023

[22] Filed: Jan. 30, 1991

[30] Foreign Application Priority Data

Feb. 7, 1990 [IT] Italy ..... 47603 A/90

[51] Int. Cl.[5] ..... E01F 13/00; E01F 15/00

[52] U.S. Cl. ..... 404/6; 256/1

[58] Field of Search ..... 404/6; 256/1

[56] References Cited

U.S. PATENT DOCUMENTS

| | | | |
|---|---|---|---|
| 2,000,974 | 5/1935 | Mead | 404/6 X |
| 3,674,115 | 7/1972 | Young et al. | 404/6 X |
| 3,845,936 | 11/1974 | Boedecker et al. | 404/6 X |
| 3,876,185 | 8/1975 | Welch | 256/1 |
| 3,880,404 | 8/1975 | Fitch | 256/1 |
| 4,007,917 | 2/1977 | Brubaker | 404/6 X |
| 4,062,521 | 12/1977 | Moreau | 256/1 |
| 4,290,585 | 9/1981 | Glaesener | 404/6 X |
| 4,352,484 | 10/1982 | Gertz et al. | 404/6 X |
| 4,600,178 | 7/1986 | Zucker et al. | 256/1 |
| 4,645,375 | 2/1987 | Carney, III | 404/6 |

*Primary Examiner*—Ramon S. Britts
*Assistant Examiner*—Nancy P. Connolly
*Attorney, Agent, or Firm*—Joseph W. Farley

[57] ABSTRACT

A shock energy dissipation traffic divider barrier comprises a plurality of aligned energy dissipating members (1) slidably supported on a bearing surface (2), each of the dissipating members having a guide extending transversely therethrough. An anchoring cable (4), fastened at a point before the first or leading dissipating member, extends through each of the dissipating members in slidable engagement with its guide and is connected to a shoulder (5) behind the last of the dissipating members with a compression spring (6).

19 Claims, 5 Drawing Sheets

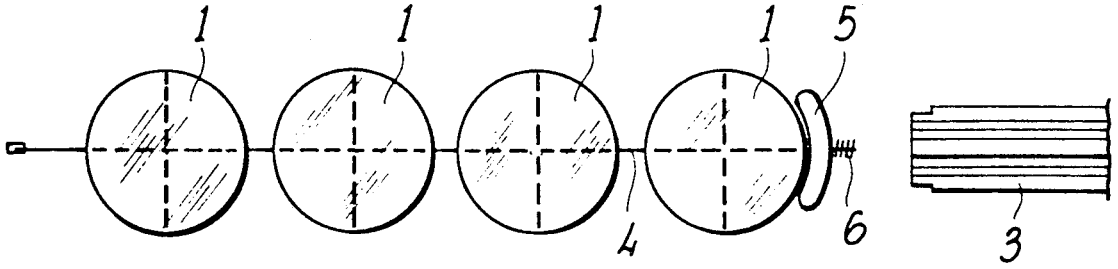
FIG. 4a
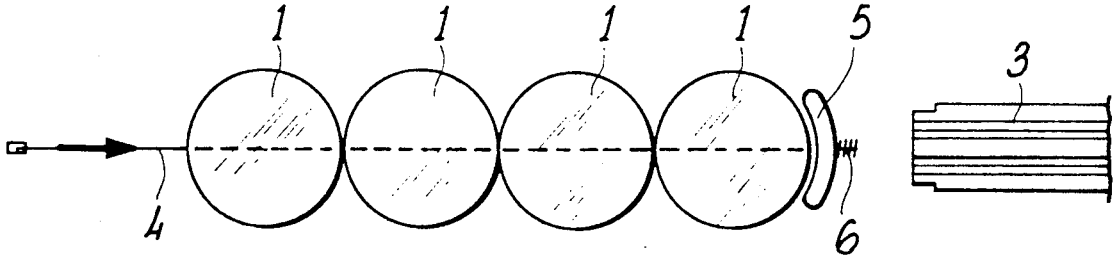
FIG. 4b
FIG. 4c
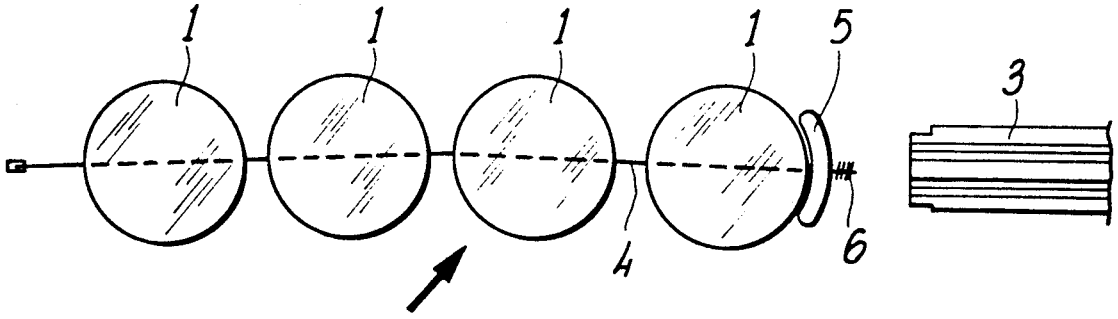

SHOCK ENERGY DISSIPATION TRAFFIC DIVIDER BARRIER

This invention relates to a shock energy dissipation traffic divider barrier.

More particularly, this invention relates to a barrier of the type mentioned above, that can be employed in the field pertaining to roads and/or to airports, for urban and extraurban structures, said barrier providing a structure capable of ensuring an optimal dampening of impacts and of strongly reducing the cost of maintenance.

At present, metal plate members are usually employed as traffic dividers, said members making up a reinforced barrier especially at places close to exit points. Such kind of barrier is realized through the overlapping of a number of plates and many uprights so as to obtain a sufficient size to realize the necessary stiffness and the necessary impact strength.

However, their assembling has put into evidence the need for a remarkable maintenance that, in some cases, means even the need for the partial or total reconstruction of the whole structure.

Another kind of traffic divider member that has been adopted consists of a rubber and a metal plate end member. More particularly, it provides a number of plates with the interposition of rubber members (as for instance tires).

Such devices, following to repeated impacts, require the total or partial reconstruction, so that the maintenance costs of the same are definitely high.

A third type of traffic divider member adopted at the present time is made up of a light aerated concrete structure, which comprises a plurality of dovetail-shaped, series-connected members, which in case of impact are intended for a partial or total destruction so that, in some cases, fragments are found on the roadway.

Accordingly, the Applicant intended to realize an impact energy dissipation traffic divider barrier capable of optimally supporting both front and side impacts without requiring a remarkable maintenance.

These results are obtained together with other results, according to the present invention, by suggesting the realization of a traffic divider barrier made up of a sequence of cellular members which are generally of cylindrical or elliptical cross-section and are made up of rubber or of any other material having a suitable elastic modulus, said members resting on the ground or on a basement and being connected to the ground through a horizontal, predetermined-stretch anchoring device.

Accordingly, the specific object of the present invention consists in a shock energy dissipation traffic divider barrier comprising a plurality of aligned dissipating members which rest on the supporting surface and are each one provided with a transverse guide for the passage of anchoring rope means which are fastened at a point before the first or "leading" dissipating member and at a point behind the last one of said dissipating members, directly to the supporting surface of said dissipating members, so that said dissipating members can slide along said rope means; said rope means being provided with at least one predetermined stretch device.

According to a preferred embodiment of the barrier according to the present invention, a bearing member or shoulder is provided at a point behind the last one of said dissipating members, said bearing member being so shaped as to supply a supporting surface that perfectly couples to said dissipating member, said rope means that come out of said dissipating member being coupled to said bearing member or shoulder.

More particularly, said dissipating members have a cellular or any other similar equivalent structure and they are cylindrical or elliptical in shape.

Just for exemplification purposes, a height of 100 cm and a diameter of 120 cm can be reported for each one of said dissipating members.

Moreover, they can be arranged by placing them directly on the road pavement or on a reinforced concrete basement which has been realized as a completely separated member with respect to the already existing barrier.

Preferably, said dissipating members are made up of rubber or of any other material having a suitable elastic modulus and deformability. More particularly, a material will be needed having an elastic modulus E of 20–80 $kg/cm^2$ and a SHOR hardness of 20–85 SH/A.

The energy dissipating members of the barrier according to the present invention can be arranged close to one another or at a slight distance from one another, but in any case the last member will always rest on said suitably shaped bearing member, when such a member is provided.

Preferably, a sequence of 3 or 4 energy dissipating members is provided.

The sequence of said energy dissipating members aligned to form the barrier according to the present invention can be provided with a first or leading dissipating member and with a terminal dissipating member, both supplied with a guide for the passage of the anchoring rope means, said guide being arranged at a slope so as to allow the rope means anchored to the ground to enter and to exit at the height provided for their passage through the successive energy dissipating members, said sequence being also provided with one or more energy dissipating members including a horizontal guide for the passage of said rope means.

According to another embodiment of the barrier of the present invention, each one of said energy dissipating members can be provided with a sloping guide and with a horizontal guide, which are arranged at right angles to one another, so that each member can be indifferently employed as the leading or first member and/or as the terminal member of the sequence, or not as the end member as well.

Preferably, said horizontal guide is realized at a height of about 20 cm from the group level.

Preferably, said anchoring rope means are made up of a steel rope of suitable size.

The predetermined-stretch device of said rope means can be arranged on said rope means themselves indifferently at the leading position and/or at an intermediate position and/or at the terminal position.

According to the present invention, said predetermined stretch device is preferably arranged at the terminal portion of said rope means, at the point corresponding to the coupling with said bearing member, and said device consists of a steel spring that is compressively stressed.

The present invention will be disclosed in the following according to some preferred embodiments of the same with particular reference to the figures of the enclosed drawings, wherein:

FIGS. 4a, 4b and 4c are three top views of the barrier according to the present invention, respectively in the rest position, after a front impact, and after a side impact;

Figure 1:
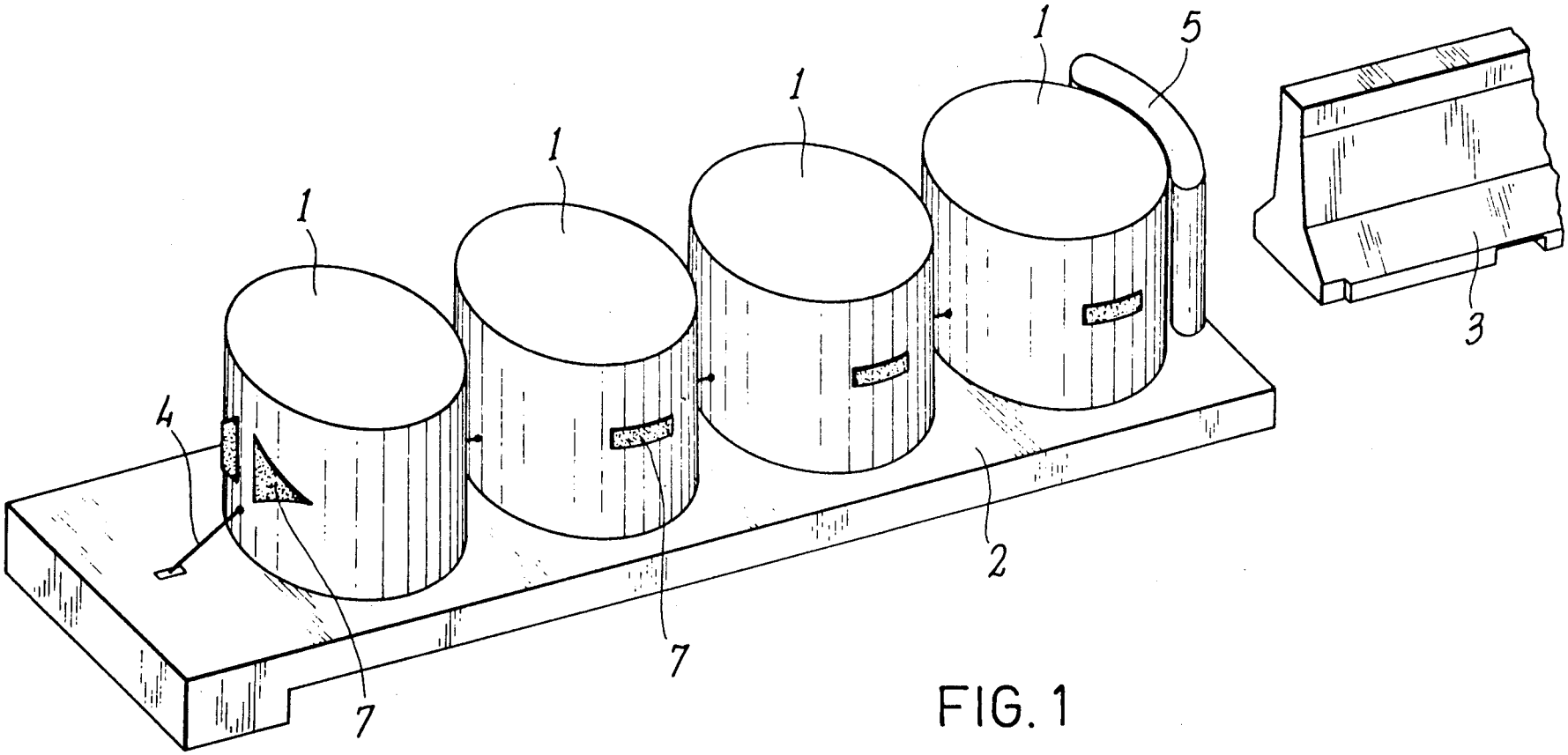
FIG. 1 is a perspective view of a kind of embodiment of the barrier according to the present invention.
Figure 2:
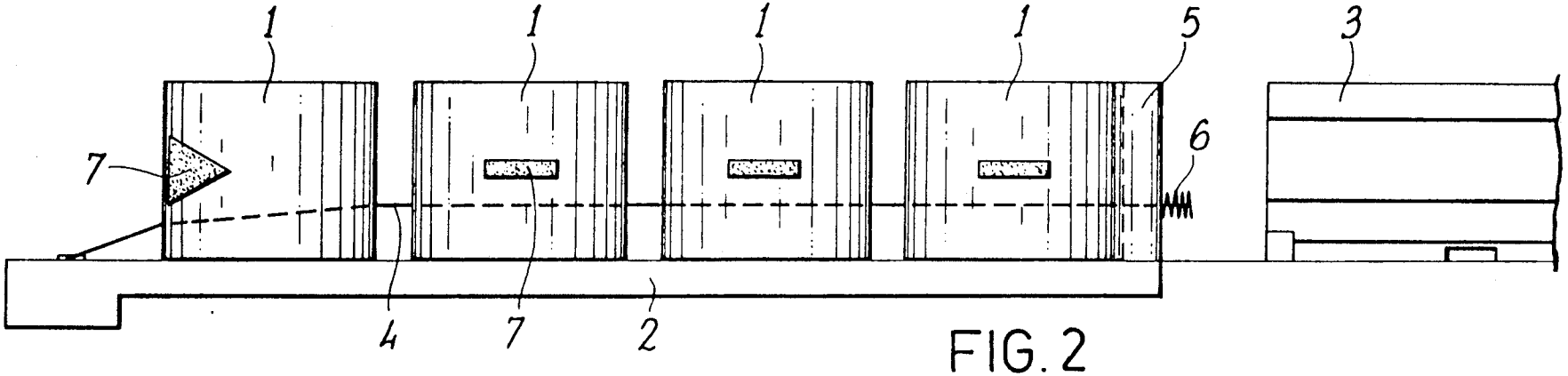
FIG. 2 is a side view of the barrier shown in FIG. 1.
Figure 3:
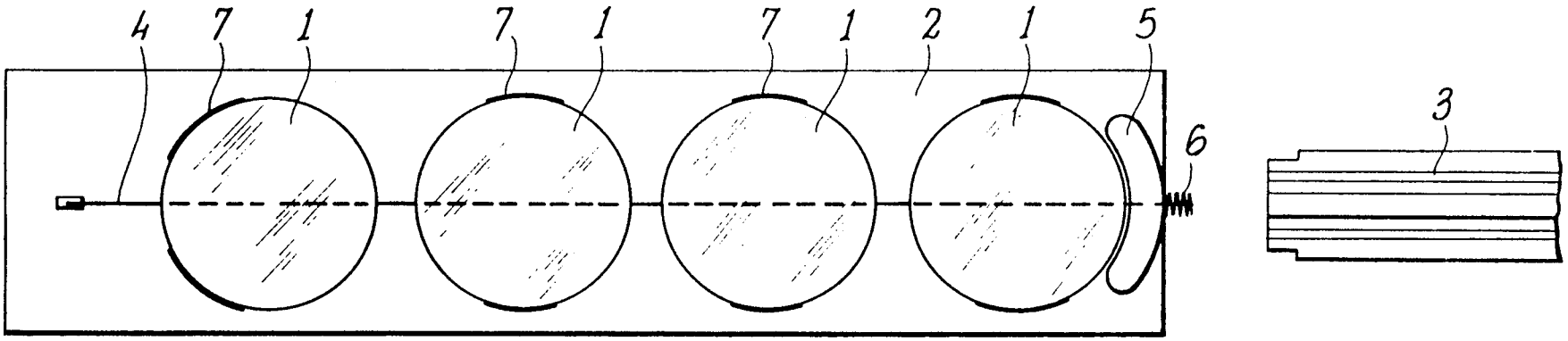
FIG. 3 is a top view of the barrier shown in FIG. 1.

The traffic divider barrier according to the present invention comprises, in the kind of embodiment shown in the drawings mentioned above, four energy dissipating members 1, of circular cross-section, which are made up of rubber.

Said energy dissipating members 1 are supported on a reinforced concrete basement 2 which is completely independent of the already existing traffic divider 3.

The anchoring of said energy dissipating members 1 to the ground is realized by means of a metallic rope 4 that passes through them along the diametrical direction at a height of about 20 cm.

Said rope 4 is fastened at a point before the first of the dissipating members 1, i.e. at a point before the dissipating member that occurs frontally to the vehicle, directly to said basement 2.

On the contrary, the rope 4 is coupled to a reinforced concrete shoulder 5 at the point corresponding to the last one of said dissipating members 1, said coupling being realized by means of a device that allows the same to become stretched at a predetermined extent, and that comprises the steel spring 6 arranged behind said shoulder 5, said spring working compressively under stress.

The last of said energy dissipating members 1 is supported on said shoulder 5 of suitable shape.

Each one of said energy dissipating members 1 is provided with an inner guide for the passage of the rope 4. In the case of the first one of said members 1 the guide is oblique in order to allow the rope 4 anchored to the ground to be inserted, whereas in the other members 1 said guide will be horizontal, at a height of about 20 cm.

In order to realize a single kind of dissipating member 1 in a way independent of whether said member is to be the leading member or not of the barrier, it can be provided with both a horizontal guide for employing the same as an intermediate or a terminal member, and an oblique guide, in case it is to be employed as the leading member.

Reflex reflectors 7 are provided on the energy dissipating members 1.

Figure 5:
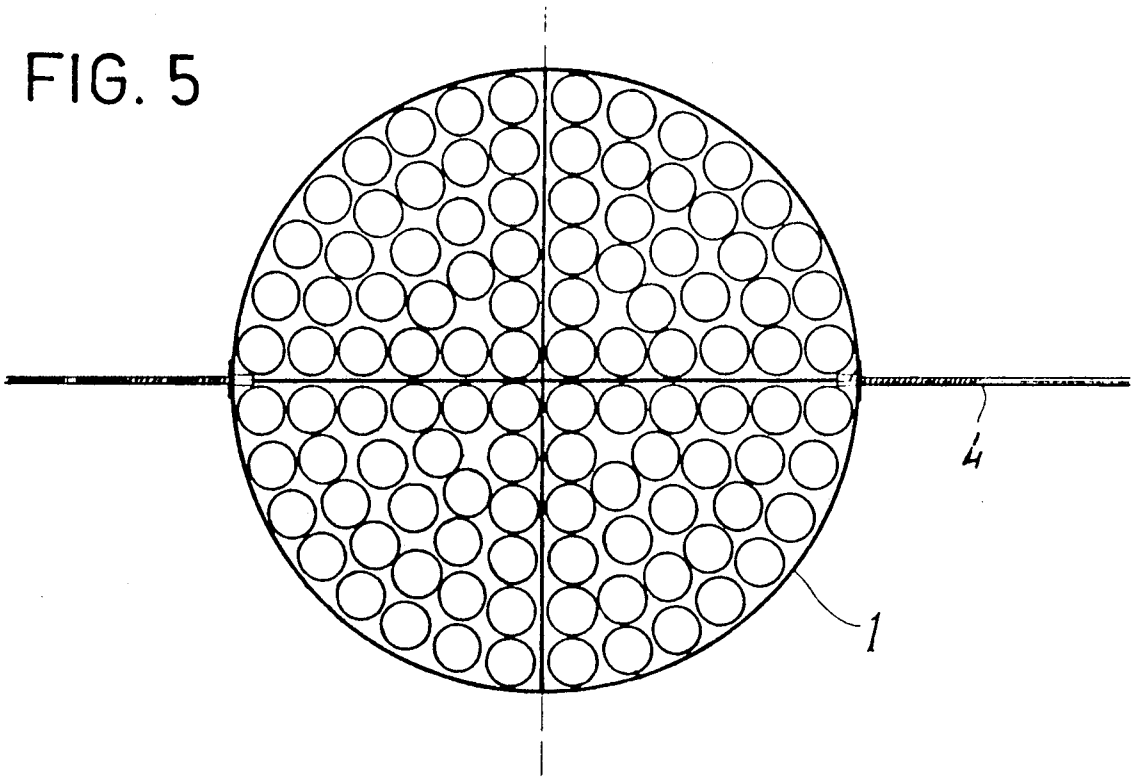
FIG. 5 shows a cross-sectional view of an energy dissipating member of the barrier according to the present invention.

As can be observed in FIG. 5, the dissipating members 1 have a cellular structure so that they are elastically deformable in order to be able to absorb the impact energy and to reemploy completely said members after impact.

Looking now at the FIGS. 4a, 4b and 4c, the effects of a front or side impact on a barrier of the structure according to the present invention can be observed.

Actually, as a consequence of a front impact (FIG. 4b) the maximum kinetic energy dissipation occurs because the particular configuration of said rope 4 allows the direct impact of the first dissipating cylindrical member 1 to occur, which member, translating itself along the rope 4 strikes the successive member 1 and so on, so that the impact energy dissipation occurs at the expense of the deformation energy of the single dissipating members 1, as well as of the change in the momentum occurring in the shifting of the single members 1.

In case of a side impact (FIG. 4c), the stress of the rope 4 itself that becomes pulled, so compressing the spring 6 against the shoulder 5 adds to the energy dissipating effect caused in this case at a lower degree to the deformation of the single members 1 and to the shifting of such members, said shifting being limited by the stretching possibility allowed by said spring 6 to the rope 4.

Finally, the impact dampening by means of the barrier according to the present invention is obtained through:

- the deformation of the single dissipating member 1 which undergoes directly or indirectly the action of the impact force;
- the translation and sliding motions along the anchoring rope 4 of the members 1 striken, with the cooperation of a number of said members 1 to the dampening of the impressed kinetic energy;
- the elastic strength exerted by said predetermined stretch device 6, in case of an oblique impact;
- the change in the momentum of the single members 1 that overcome the friction force at the contact between a member 1 and the basement (or pavement) 2.

Figure 6:
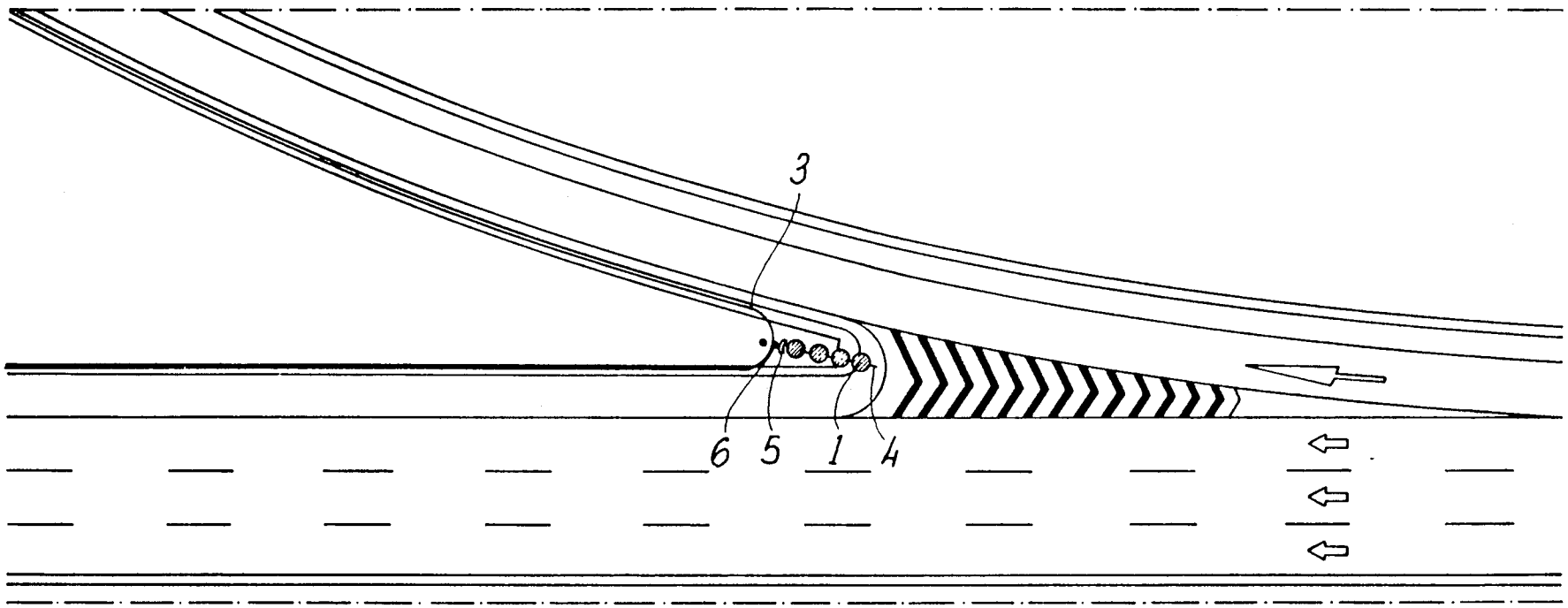
FIG. 6 shows schematically a possible application of the barrier according to the present invention.

FIG. 6 shows schematically the application of a barrier according to the present invention near an exit point, but it is evident that such a barrier can be employed in other kinds of applications at places close to openings for traffic divider gates, exit points, roads leading to turnpike gates, and so on.

This invention has been disclosed with specific reference to some preferred embodiments of the same, but it is to be understood that modifications and changes can be introduced by those who are skilled in the art without departing from the spirit and scope of the invention for which a priority right is claimed.

I claim:

1. A shock energy dissipation traffic divider barrier comprising a plurality of aligned dissipating members bearing on a supporting surface, said dissipating members including a first member and a last member, each of said dissipating members having a guide extending transversely therethrough, anchoring rope means fastened to said supporting surface at a point before said first member and at a point behind said last member, said rope means passing through each of said dissipating members in slidable engagement with said guide thereof whereby said dissipating members can slide along said rope means, and spring means connected to said rope means for resilient deformation in response to displacement of said dissipating members from aligned relation.

2. A shock energy dissipation traffic divider barrier according to claim 1, wherein a shoulder member is provided at a point behind said last dissipating member, said shoulder member being rigidly fastened to said supporting surface and being shaped to correspond with the adjacent surface of said last member, said rope means passing through the guide of said last member and being fastened to said shoulder member.

3. A shock energy dissipation traffic divider barrier according to claim 2 wherein said spring means comprises a compression spring, said rope means extending through said shoulder member and having a terminal portion on which said compression spring is provided behind said shoulder member.

4. A shock energy dissipation traffic divider barrier according to claim 1, wherein said dissipating members have a cellular structure.

5. A shock energy dissipation traffic divider barrier according to claim 1, wherein said dissipating members are of cylindrical or elliptical shape.

6. A shock energy dissipation traffic divider barrier according to claim 1, wherein each energy dissipating member is about 100 cm high and 120 cm diameter.

7. A shock energy dissipation traffic divider barrier according to claim 1, wherein said supporting surface is a roadway pavement.

8. A shock energy dissipation traffic divider barrier according to claim 1, wherein said dissipating members are supported by a reinforced concrete basement which is completely separated from an existing barrier.

9. A shock energy dissipation traffic divider barrier according to claim 1, wherein said dissipating members are made of rubber or any other material having a suitable elastic modulus and a suitable deformability.

10. A shock energy dissipation traffic divider barrier according to claim 9, wherein said material has an elastic modulus E equal to 20-80 kg/cm2 and an SHOR hardness equal to 20-85 SH/A.

11. A shock energy dissipation traffic divider barrier according to claim 1, wherein said dissipating members are arranged at a distance from one another.

12. A shock energy dissipation traffic divider barrier according to claim 1, wherein said dissipating members are arranged close to one another.

13. A shock energy dissipation traffic divider barrier according to claim 1, wherein 3 to 4 dissipating members are provided.

14. A shock energy dissipation traffic divider barrier according to claim 1, wherein said first dissipating member and said last dissipating member have said guide for the passage of said anchoring rope means arranged at a slope, and one or more intermediate dissipating members have a horizontal guide for the passage of said rope means.

15. A shock energy dissipation traffic divider barrier according to claim 1 wherein each of said dissipating members is provided with a sloping guide and a horizontal guide, said guides being arranged at right angles to one another for the passage of said rope means through a selected one of said guides.

16. A shock energy dissipation traffic divider barrier according to claim 1, wherein said rope means comprises a steel rope.

17. A shock energy dissipation traffic divider barrier according to claim 1, wherein said spring means is provided on the said rope means at a leading position and/or at an intermediate position and/or at a terminal position.

18. A shock energy dissipation traffic divider barrier according to claim 17, wherein said spring means is provided at the terminal portion of said rope means.

19. A shock energy dissipation traffic divider barrier according to claim 18, wherein said spring means comprises a steel spring that is compressively stressed.

* * * * *